US007560629B2

(12) United States Patent
Terada et al.

(10) Patent No.: US 7,560,629 B2
(45) Date of Patent: Jul. 14, 2009

(54) KEYBOARD-TYPE PERCUSSION INSTRUMENT

(75) Inventors: Norishige Terada, Hamamatsu (JP); Tetsuo Hotta, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 32 days.

(21) Appl. No.: 11/971,630

(22) Filed: Jan. 9, 2008

(65) Prior Publication Data

US 2008/0245209 A1 Oct. 9, 2008

(30) Foreign Application Priority Data

Jan. 11, 2007 (JP) ..... 2007-003504

(51) Int. Cl.
*G10C 3/18* (2006.01)

(52) U.S. Cl. ..... 84/236

(58) Field of Classification Search ..... 84/235–238, 84/426, 433, 442, 444, 173
See application file for complete search history.

(56) References Cited

U.S. PATENT DOCUMENTS 5,610,356 A * 3/1997 Koseki et al. ..... 84/719
6,194,649 B1 * 2/2001 Itou et al. ..... 84/719

FOREIGN PATENT DOCUMENTS

JP 5-81895 11/1993

* cited by examiner

*Primary Examiner*—Kimberly R Lockett
(74) *Attorney, Agent, or Firm*—Dickstein Shapiro LLP

(57) ABSTRACT

A keyboard-type percussion instrument having sounding members arranged to correspond to respective ones of keys and capable of improving musical performance in soft tone. When a soft pedal is stepped on, a pedal connecting rod is moved upward to move an arm portion of a lifting arm upward, whereby the lifting arm is pivoted to cause capstan screws to be inserted into through holes of a key frame, thus moving a lifting bar upward so that an upper surface of the lifting bar projects from the key frame to push rear end portions of all the keys upward. As a result, standby positions of hammer felts are moved toward the sounding members, whereby the volume of a tone generated by a sounding member struck by a hammer felt corresponding to a depressed key is decreased.

4 Claims, 16 Drawing Sheets

KEYBOARD-TYPE PERCUSSION INSTRUMENT

BACKGROUND OF THE INVENTION

1. Field of the Invention

The present invention relates to a keyboard-type percussion instrument having sounding members each adapted to generate a musical tone when struck.

2. Description of the Related Art

A keyboard-type tone plate percussion instrument has been known, which includes a plurality of keys, hammer actions respectively corresponding to the keys, rectangular tone plates (sounding members) each adapted to be struck by a corresponding hammer action, and resonance boxes disposed above the tone plates and causing tones generated by tone plates to resonate therein (see, for example, Japanese Utility Model Laid-open Publication No. 05-081895). The hammer actions of this tone plate percussion instrument are similar to those of a grand piano. When any of the keys is depressed by a player, a corresponding hammer action strikes a tone plate concerned, whereby the tone plate vibrates to generate a musical tone of a tone pitch proper to the tone plate.

A grand piano of the type including hammer actions similar to those disclosed in Japanese Utility Model Laid-open Publication No. 05-081895 is provided with a soft pedal that makes it easy to generate a soft tone. In such a grand piano, a plurality of strings are provided for each key, and when any of the keys is depressed by a player, a corresponding plurality of strings are struck. When the soft pedal is stepped on by the player, a positional relation between each hammer and corresponding strings is changed to decrease the number of strings struck by the hammer, whereby the volume of a generated musical tone is made small.

Although the keyboard-type tone plate percussion instrument disclosed in Japanese Utility Model Laid-open Publication No. 05-081895 includes hammer actions similar to those of a grand piano, there is only provided one tone plate for each key. In this tone plate percussion instrument, therefore, it is impossible to adopt a construction for decreasing the volume of tone by reducing the number of tone plates struck by a corresponding hammer, and thus the player wishing to produce a soft tone is required to finely adjust a key depression force, making it difficult to produce a soft tone in a musical performance.

SUMMARY OF THE INVENTION

The present invention provides a keyboard-type percussion instrument having sounding members arranged to correspond to respective ones of keys and capable of improving musical performance in soft tone.

According to the present invention, there is provided a keyboard-type percussion instrument comprising a plurality of keys, sounding members arranged to correspond to respective ones of the keys and each adapted to generate, when struck, a musical tone of a tone pitch proper to the sounding member, action mechanisms arranged to correspond to respective ones of the keys and each having a hammer adapted to strike a corresponding one of the sounding members in accordance with a motion of a corresponding one of the keys, a pedal, and a standby position adjusting unit adapted to change positions of the hammers observed when the plurality of keys are in a standby state in accordance with a motion of the pedal.

In this invention, the plurality of keys can each be supported by a fulcrum for pivotal motion around the fulcrum, each of the hammers can be adapted to strike a corresponding one of the sounding members with a pivotal motion of a corresponding one of the keys, and the standby position adjusting unit can be adapted to move the positions of the hammers observed when the plurality of keys are in the standby state in accordance with a motion of the pedal.

The positions of the hammers observed when the plurality of keys are in the standby state and having been changed in accordance with a motion of the pedal can be fixed by the pedal being operated in a predetermined direction.

The plurality of keys and the action mechanisms arranged to correspond to respective ones of the keys can be unitized by being supported by a key frame.

The keyboard-type percussion instrument of this invention having sounding members arranged to correspond to respective ones of keys can improve musical performance in soft tone.

Further features of the present invention will become apparent from the following description of an exemplary embodiment with reference to the attached drawings.

BRIEF DESCRIPTION OF THE DRAWINGS

FIG. 15 is an enlarged view showing the rear end portion of the key and its vicinity in a state where a soft pedal is stepped on;

FIG. 17A is an enlarged view showing the soft pedal and its vicinity in a state where the soft pedal is not stepped on.

DETAILED DESCRIPTION OF THE PREFERRED EMBODIMENTS

The present invention will now be described in detail below with reference to the drawings showing a preferred embodiment thereof.

FIGS. 1A to 1D respectively show in rear view, left side view, front view, and right side view a keyboard-type percussion instrument 10 according to one embodiment of this invention. In the following description, the side of the percussion instrument 10 toward a player is referred to as the front side thereof, and left and right directions thereof are determined in reference to the player facing the percussion instrument 10.

Figure 1A:
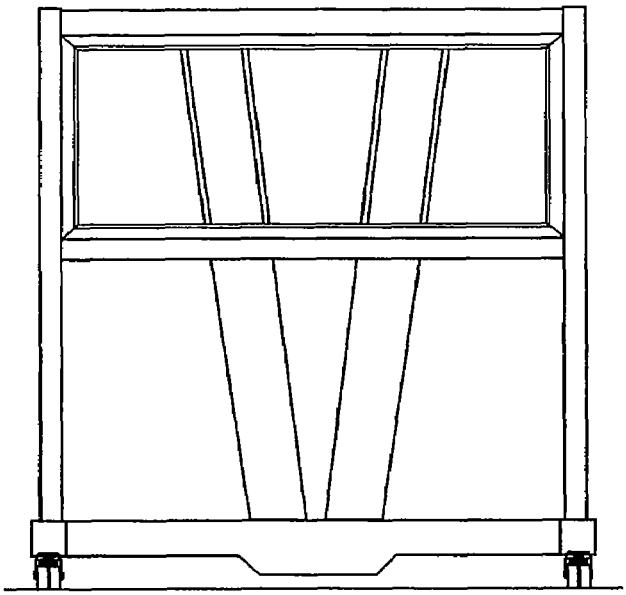
FIG. 1A is a rear view of a keyboard-type percussion instrument according to one embodiment of this invention.
Figure 1B:
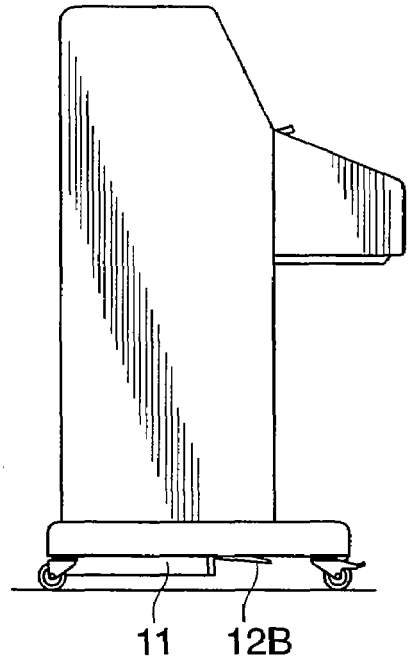
FIG. 1B is a left side view of the percussion instrument.
Figure 1C:
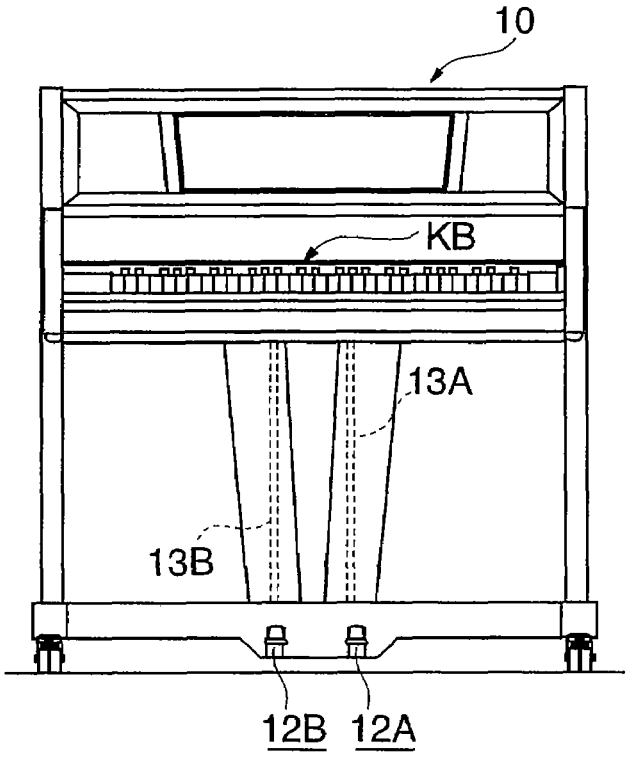
FIG. 1C is a front view of the percussion instrument.
Figure 1D:
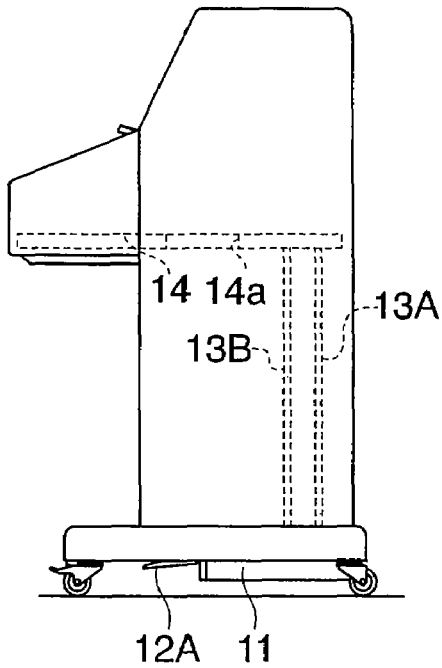
FIG. 1D is a right side view of the percussion instrument.

First, an explanation will be given of the outline of the keyboard-type percussion instrument 10. This percussion instrument 10 is adapted to cause each of metallic sounding members to vibrate to generate a musical tone when the sounding member is struck. As shown in FIG. 1C, the percussion instrument 10 includes a keyboard KB having a plurality of white keys and black keys, a damper pedal 12A and a soft pedal 12B which are adapted to be operated by a foot of a player, and a pedal box 11 in which there are provided a mechanism for vertically moving a pedal coupling rod 13A in accordance with a motion of the damper pedal 12A and a mechanism for vertically moving a pedal coupling rod 13B in accordance with a motion of the soft pedal 12B.

When any of the keys of the keyboard KB is depressed by a player, a corresponding one of the sounding members, which are disposed inside the keyboard-type percussion instrument 10 to correspond to respective ones of the keys, is struck to generate a musical tone. The damper pedal 12A is adapted to control vibration of the sounding members. Specifically, in a state that the damper pedal 12A is stepped on by the player, even if the key is no longer depressed by the player, the corresponding sounding member is not suppressed from vibrating. Thus, a time period for which a musical tone is sounded from the struck sounding member becomes longer as compared to the case where the damper pedal 12A is not stepped on.

The soft pedal 12B is for controlling the volume of a tone generated by each sounding member. Provided that a key depression force applied by the player is the same, the volume of a tone generated when any of the sounding members is struck becomes smaller when the soft pedal 12B is stepped on by the player than when the soft pedal 12B is not stepped on. In this embodiment, the mechanism for moving the pedal connecting rod 13B in the vertical direction in response to the upward and downward movement of the soft pedal 12B is the same as that of a grand piano. When the pedal stepped on by the player is moved leftward or rightward, the stepped-on state of the pedal is kept maintained, whereby the pedal connecting rod 13B can be kept moved upward.

Figure 2:
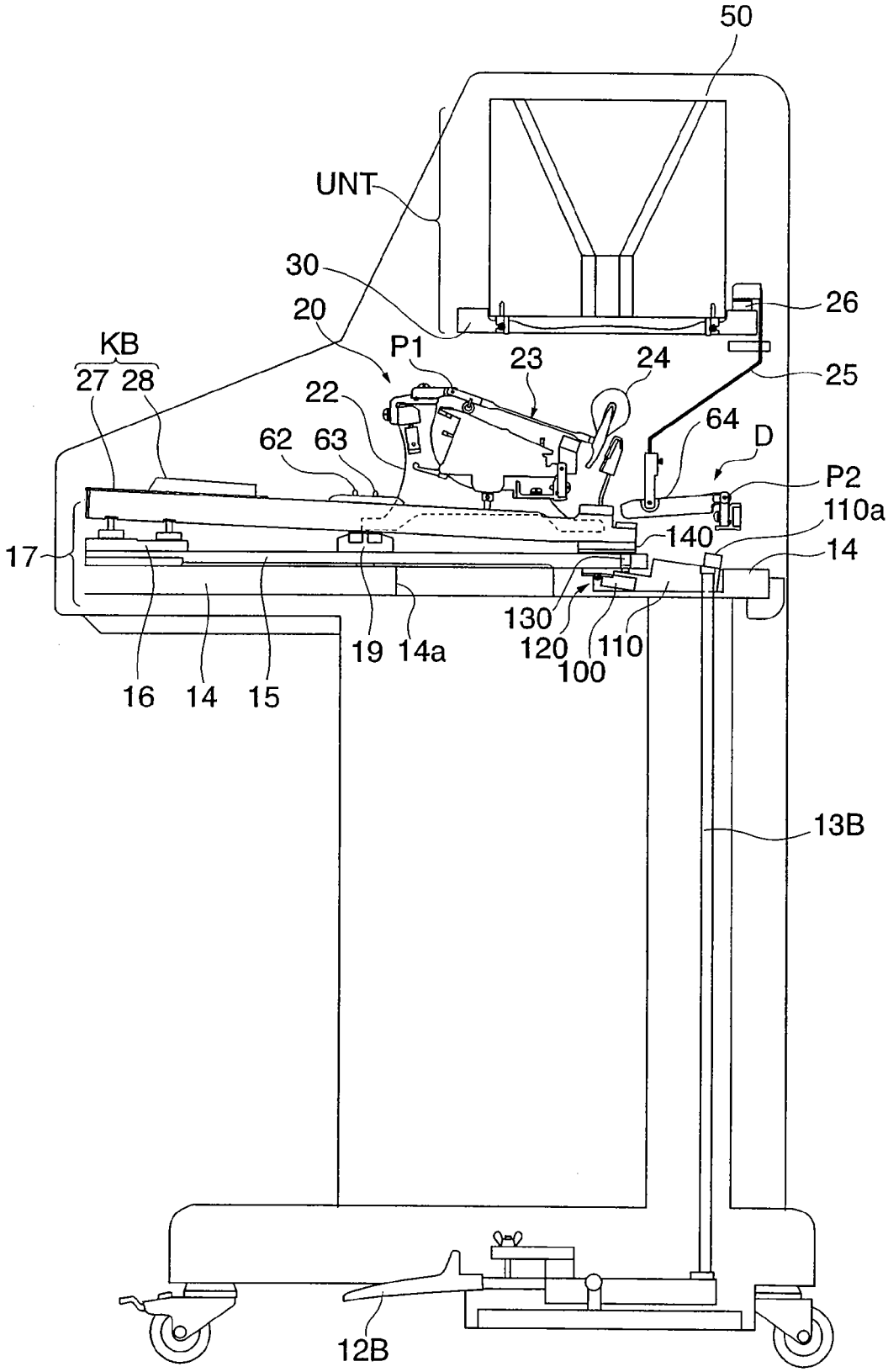
FIG. 2 is a schematic side view showing the interior of the percussion instrument.
Figure 3:
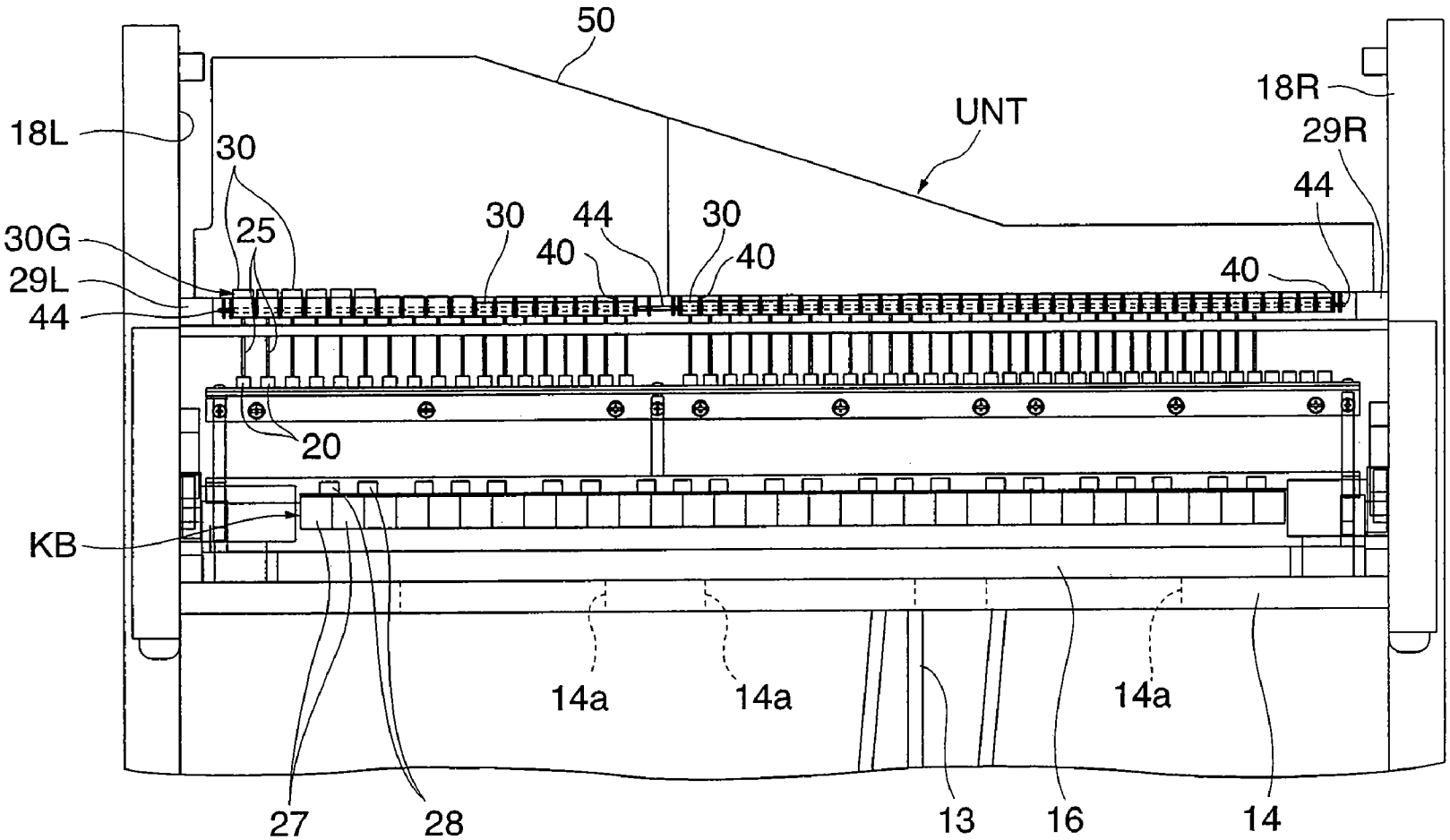
FIG. 3 is a fragmentary front view of the interior of an upper part of the percussion instrument.
Figure 4:
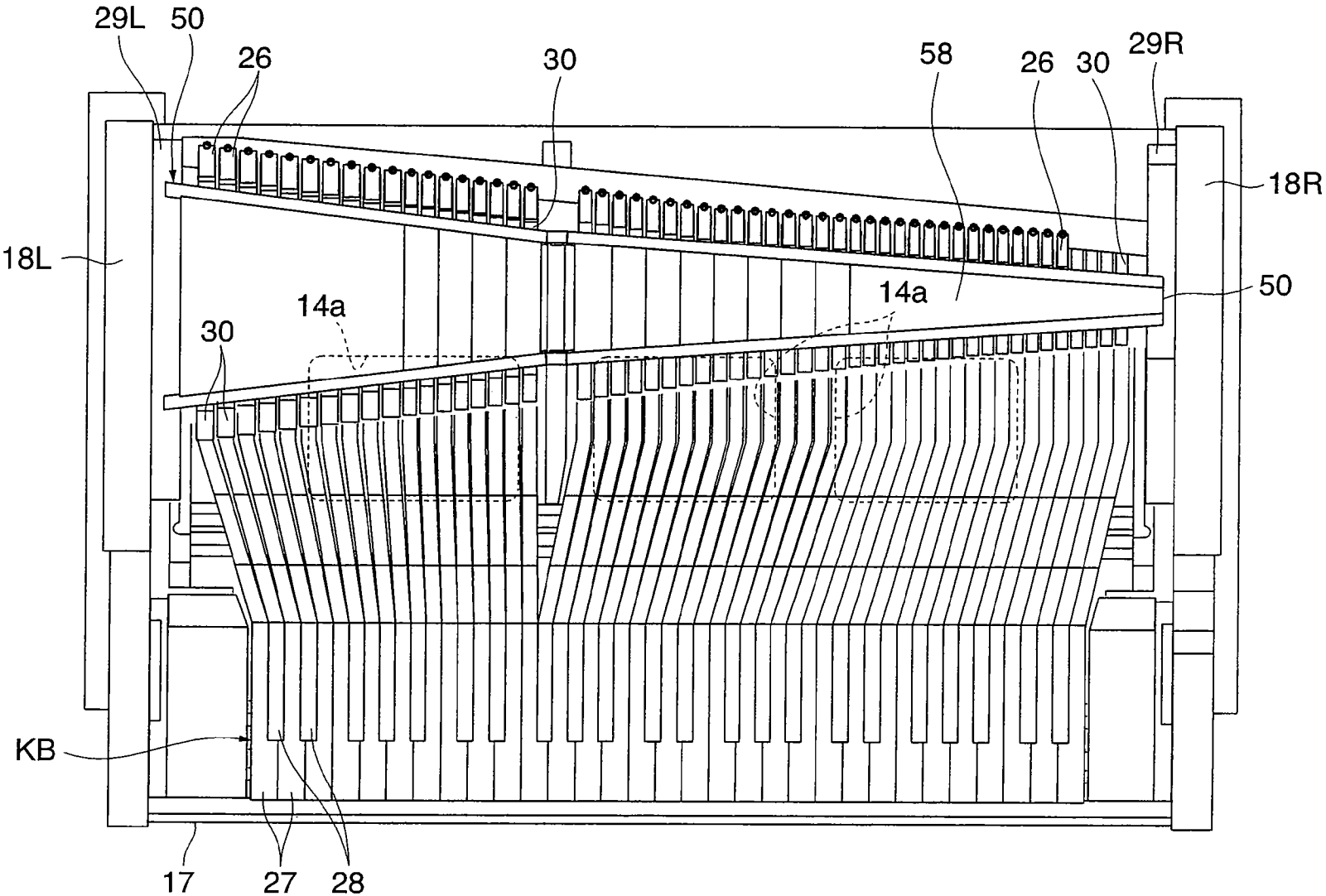
FIG. 4 is a plan view showing the interior of the percussion instrument.

Next, an explanation will be given of the internal construction of the keyboard-type percussion instrument 10. FIGS. 2 to 4 schematically show the interior of the percussion instrument 10 in side view, front view, and plan view. As shown in FIGS. 2 to 4, the percussion instrument 10 has an upper part thereof in which a tone generator unit UNT and a resonance box 50 are disposed. The tone generator unit UNT includes the sounding members 30 disposed to correspond to respective ones of the keys of the keyboard KB and adapted to generate musical tones. The resonance box 50 is adapted to cause musical tones generated by sounding members 30 to resonate therein. Furthermore, in the percussion instrument 10, action mechanisms 20 having hammer felts 24 for striking the sounding members 30, damper mechanisms D for controlling the vibration of the sounding members 30, and a mechanism for vertically moving rear end portions of the keys in accordance with a motion of the pedal coupling rod 13B are provided below the tone generator unit UNT.

Figure 5:
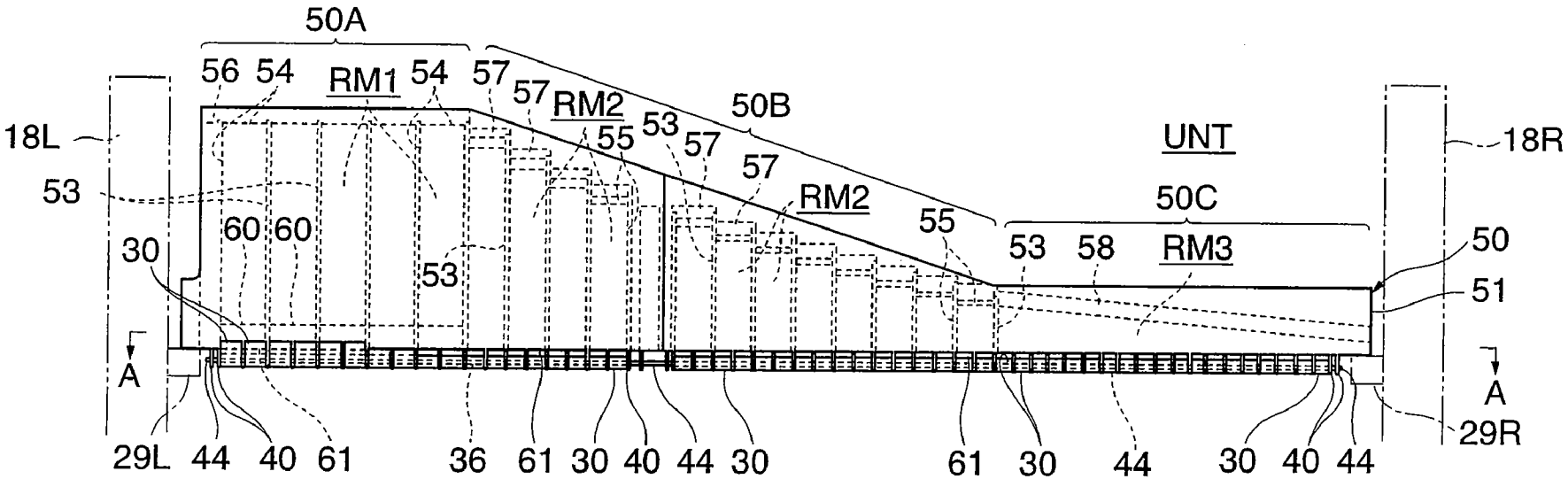
FIG. 5 is a front view of a tone generator unit of the percussion instrument.
Figure 6:
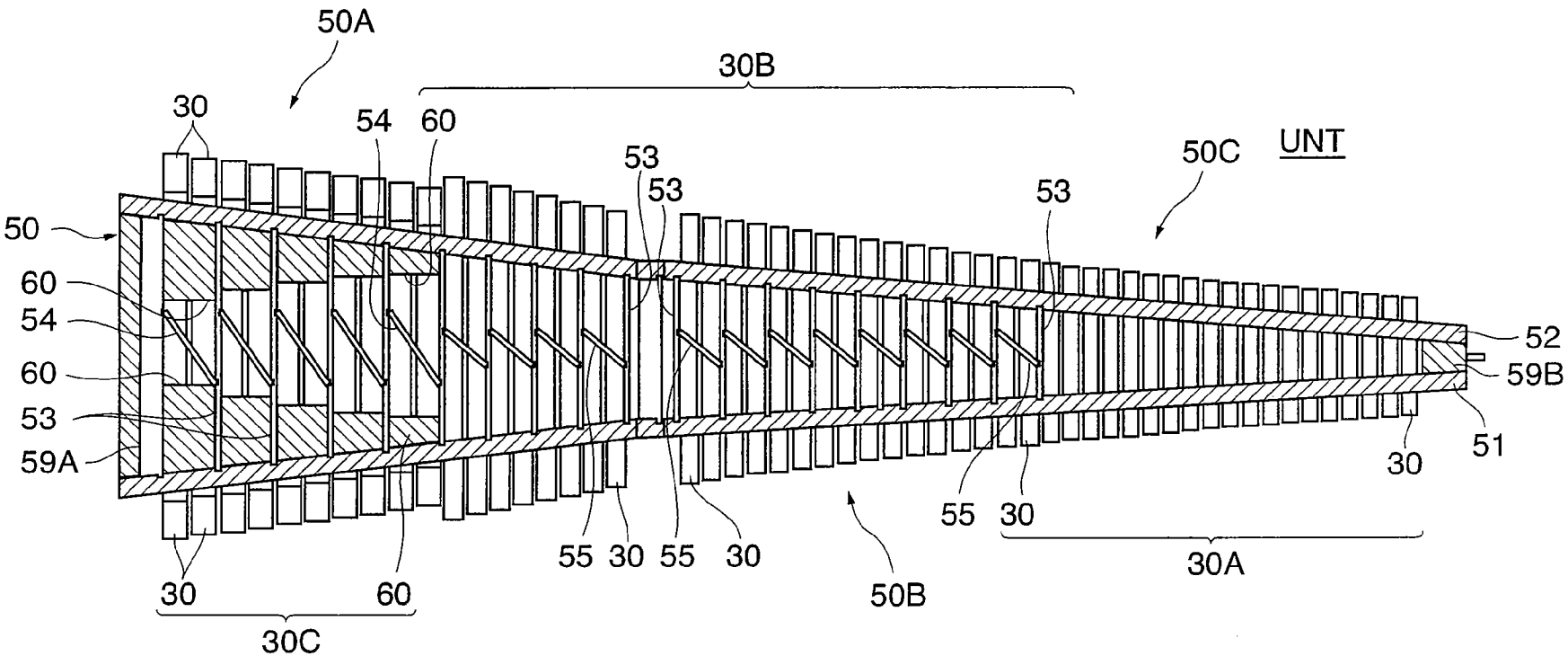
FIG. 6 is a section view taken along line A-A in FIG. 5.
Figure 7:
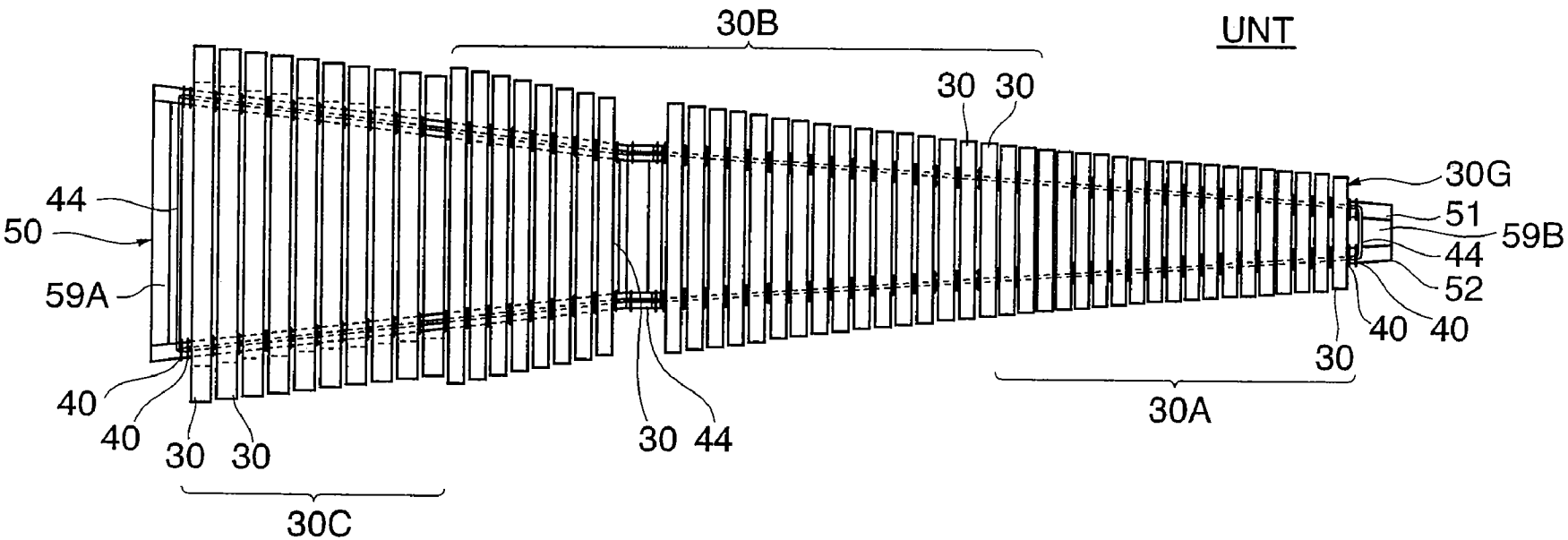
FIG. 7 is a bottom view of the tone generator unit.

First, an explanation will be given of the construction of the tone generator unit UNT. FIG. 5 shows in front view the tone generator unit UNT, FIG. 6 is a section view taken along line A-A in FIG. 5, and FIG. 7 shows in bottom view the tone generator unit UNT. As shown in FIGS. 5-7, the tone generator unit UNT includes the sounding members 30 provided to correspond to respective ones of the keys of the keyboard KB, and the resonance box 50 for causing musical tones generated by struck sounding members 30 to resonate therein. In the tone generator unit UNT, opposite end portions of the resonance box 50 are supported at their lower surfaces by supporting portions 29R, 29L respectively extending from right and left side plates 18R, 18L to the inside of the percussion instrument 10. In this embodiment, the sounding members 30 are disposed below the resonance box 50 in the key arrangement direction of the keyboard KB. The sounding members 30 are arranged such that the leftmost and rightmost sounding members 30 as seen from the player are adapted to generate musical tones of the lowest and highest tone pitches, respectively. In this embodiment, the sounding members 30 are arranged in a one-stage structure but not in an upper and lower two-stage structure. The action mechanisms 20 for striking the sounding members 30 are also arranged in a one-stage structure in the key arrangement direction of the keyboard KB.

The sounding members 30 are made of aluminum. The material of the sounding members 30 is not limited to aluminum but may be an aluminum alloy, steel, or some other metal. The sounding members 30 corresponding to respective ones of the keys are different in length, width, and shape from one another. When struck by hammer felts 24, the sounding members 30 vibrate in many different forms to generate musical tones of tone pitches proper to respective ones of the sounding members.

Specifically, as shown in FIG. 7, the sounding members 30 are divided into three sounding member groups 30A, 30B and 30C respectively belonging to high-, mid-, and low-pitch ranges. The sounding members 30 belonging to the group 30A are short in length in the longitudinal direction (forward-to-backward direction). The sounding members 30 belonging to the group 30B are longer in longitudinal length, and those members which belong to the group 30C are much longer in longitudinal length. The sounding members belonging to the group 30C are broad in width, and the sounding members 30 belonging to the group 30A are narrower in width than those belonging to the group 30C. It should be noted that the sounding members belonging to the same pitch range are the same in width from one another.

Figure 8A:
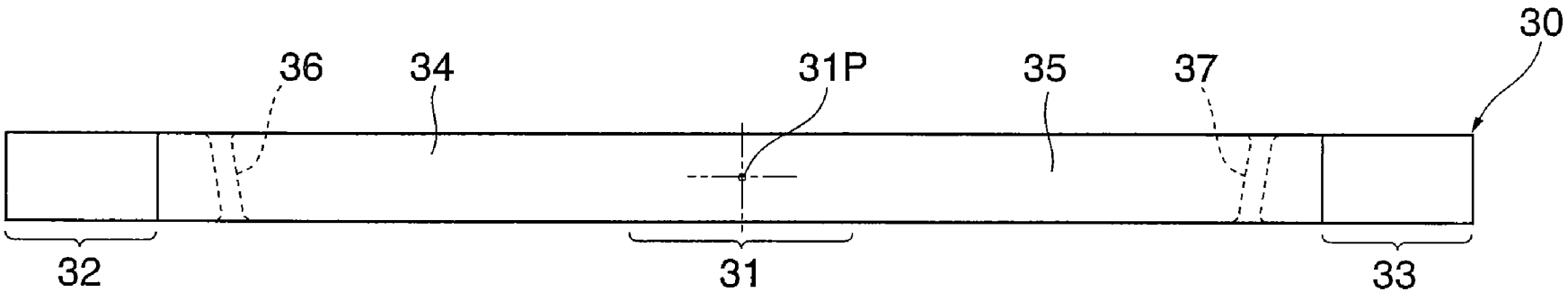
FIG. 8A is a plan view of one of sounding members of the tone generator unit.
Figure 8B:
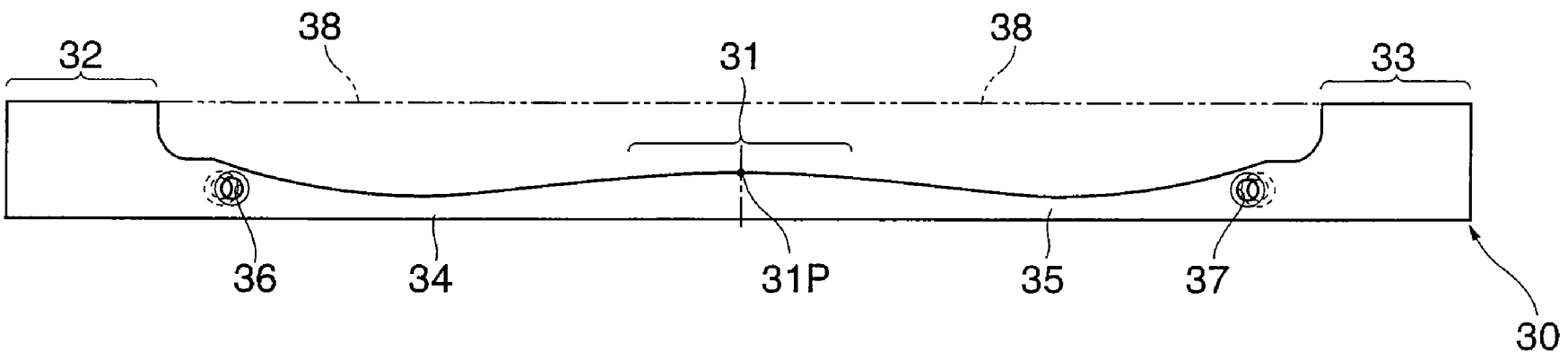
FIG. 8B is a side view of the sounding member.

FIGS. 8A and 8B show in plan view and right side view one of the sounding members 30 belonging to the sounding member group 30C (low-pitch range). This sounding member 30 has a lower surface thereof formed into a flat surface (adapted to be struck by the hammer felt 24) and front and rear end portions 32, 33 thereof thicker than an antinode portion 31 thereof (a longitudinally central portion of the sounding member where a vibration antinode can be formed). The sounding member 30 further includes first and second thinner portions 34, 35. The first thinner portion 34 is thinner than the antinode portion 31 and formed between the antinode portion 31 and the front end portion 32. The second thinner portion 35 is thinner than the antinode portion 31 and formed between the antinode portion 31 and the rear end portion 33. The center of the antinode portion 31 corresponds in position to the antinode center of vibration (hereinafter referred to as the "antinode center 31P").

Figure 9A:
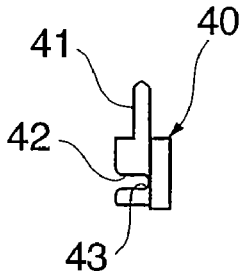
FIG. 9A is a side view of one of fasteners used for mounting the sounding members to a resonance box of the tone generator unit.
Figure 9B:
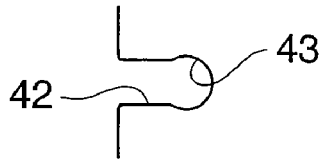
FIG. 9B is a fragmentary enlarged view of the fastener.
Figure 9C:
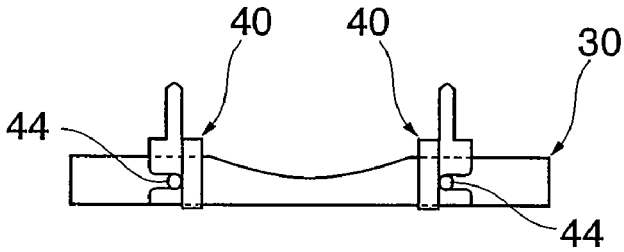
FIG. 9C is a side view of one of sounding members corresponding to a high-pitch range portion of the resonance box.
Figure 9D:
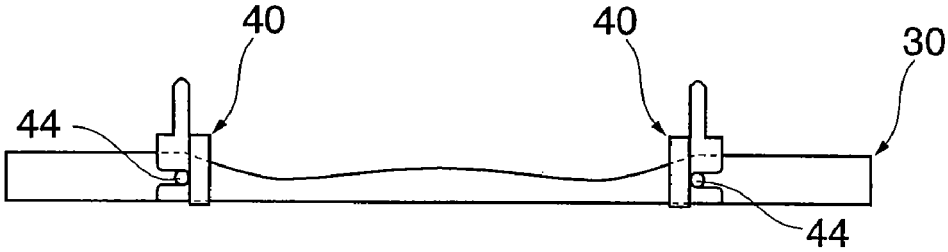
FIG. 9D is a side view of one of sounding members corresponding to a mid-pitch range portion of the resonance box.
Figure 9E:
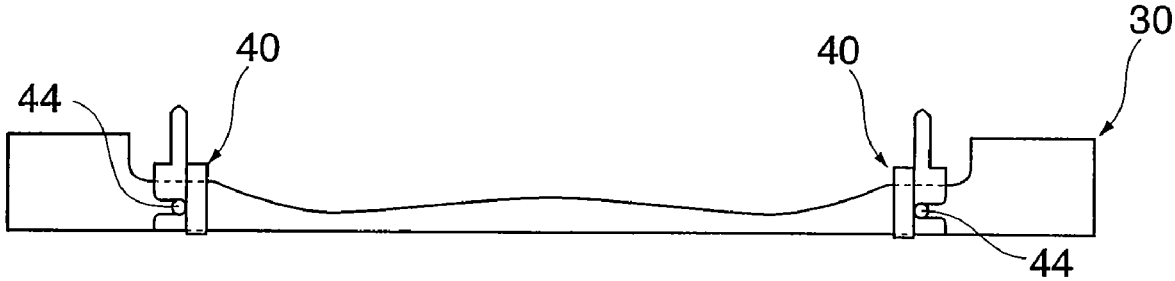
FIG. 9E is a side view of one of sounding members corresponding to a low-pitch range portion of the resonance box.

FIGS. 9C, 9D, and 9E show in side views sounding members 30 belonging to the sounding member groups 30A, 30B, and 30C, respectively. As shown in FIGS. 9C, 9D, and 9E, the sounding members 30 belonging to the groups 30A, 30B each have front and rear end portions 32, 33 thereof thinner than those of sounding members 30 belonging to the group 30C. The sounding members 30 belonging to the group 30A are not formed with portions corresponding to the first and second thinner portions 34, 35.

As shown in FIGS. 8A and 8B, the sounding member 30 is formed with supporting holes 36, 37 that extend therethrough at positions closer to the end portions of the sounding member than to the longitudinally central portion thereof. Vibration nodes can be formed in these positions. The sounding member 30 effectively generates a musical tone when caused to vibrate in a state where it is supported at the supporting holes 36, 37. As illustrated, the supporting holes 36, 37 each extend obliquely relative to the width direction of the sounding member 30 and not parallel to the width direction thereof.

Next, an explanation will be given of the construction of the resonance box 50 in which tones generated by sounding members 30 resonate. The resonance box 50 is formed into a box shape having an open lower surface, and has its front common wall 51 forming a front surface thereof, a rear common wall 52 forming a rear surface thereof, side walls 59A, 59B forming left and right side surfaces thereof, and lid members 56, 57 and 58 closing an upper surface thereof. As shown in FIG. 5, the resonance box 50 is divided into low-, mid-, and high-pitch range portions 50A, 50B, and 50C. The low-pitch range portion 50A includes Helmholtz type resonance chambers RM1, which are the same in number as sounding members 30 disposed below the low-pitch range portion 50A and which are arranged to correspond to these sounding members 30. The mid-pitch range portion 50B of the resonance box 50 includes closed-tube type resonance chambers RM2, which are the same in number as sounding members 30 disposed below the mid-pitch range portion 50B and arranged to correspond to these sounding members 30. The high-pitch range portion 50C includes a single-type resonance box in which one resonance chamber RM3 is provided, which is common to sounding members 30 disposed below the high-pitch range portion 50C.

Each of the front and rear common walls 51, 52 of the resonance box 50 is comprised of a plate-like member having two rectangular portions thereof corresponding to the low- and high-pitch range portions 50A, 50C of the resonance box 50 and a trapezoidal portion thereof corresponding to the mid-pitch range portion 50B of the resonance box 50, as shown in FIG. 5. The rectangular portion of each wall 51 or 52 corresponding to the low-pitch range portion 50A of the box 50 is larger in vertical height than another rectangular portion thereof corresponding to the high-pitch range portion 50C of the box 50. In the trapezoidal portion of each common wall of the resonance box 50, which corresponds to the mid-pitch range portion 50B of the box 50, the vertical height on the low-pitch range portion 50A side is higher than that on the high-pitch range portion 50C side. As shown in FIG. 6, the distance between the front and rear common walls 51, 52 disposed in a facing relation becomes narrower toward the right side (in which the sounding members 30 for high-pitch range are disposed) and becomes broader toward the left side (in which the sounding members 30 for low-pitch range are disposed).

As shown in FIG. 6, in the low- and mid-pitch range portions 50A, 50B of the resonance box 50, a plurality of partition plates 53 are provided between the front and rear common walls 51, 52. The partition plates 53 each comprised of a flat plate are fixed between the front and rear common walls 51, 52 and extend in parallel to one another in the forward-to-backward direction. The distance between each adjacent two of the partition plates 53 is made slightly larger than the total width of two sounding members 30 disposed therebelow. On the low-pitch range portion 50A side, the distance between the partition plates 53 becomes larger than that on the mid-pitch range portion 50B since the width of sounding members 30 differs from that of the sounding members 30 disposed below the mid-pitch range portion 50B.

In the high-pitch range portion 50C of the resonance box 50, the resonance chamber RM3 is defined by a partition plate 53 disposed between the mid- and high-pitch range portions 50B, 50C, the front and rear common walls 51, 52, and the lid member 58 closing an upper part of the high-pitch range portion 50C. As shown in FIG. 4, the lid member 58 is comprised of a plate-like member of a trapezoidal shape. The lid member 58 is connected to front and rear common walls 51, 52 and the side wall 59B so as to obliquely extend rightwardly and downwardly from the mid-pitch range portion 50B side, as shown in FIGS. 5 and 6.

In the mid-pitch range portion SOB, a space defined by each adjacent two of the partition plates 53 is divided by an inclined plate 55, which is comprised of a flat plate. The inclined plate 55 is connected to central portions of the two partition plates 53 in the forward-to-backward direction and extends obliquely as seen from above, thereby defining two resonance chambers RM2 in the space defined by the each adjacent two of the partition plates 53. In the mid-pitch range portion 50B, a lid member 57 for each of spaces defined by the partition members 53 is connected to upper portions of the partition plates 53 and the front and rear common walls 51, 52 so as to close an upper part of the space.

Figure 10:
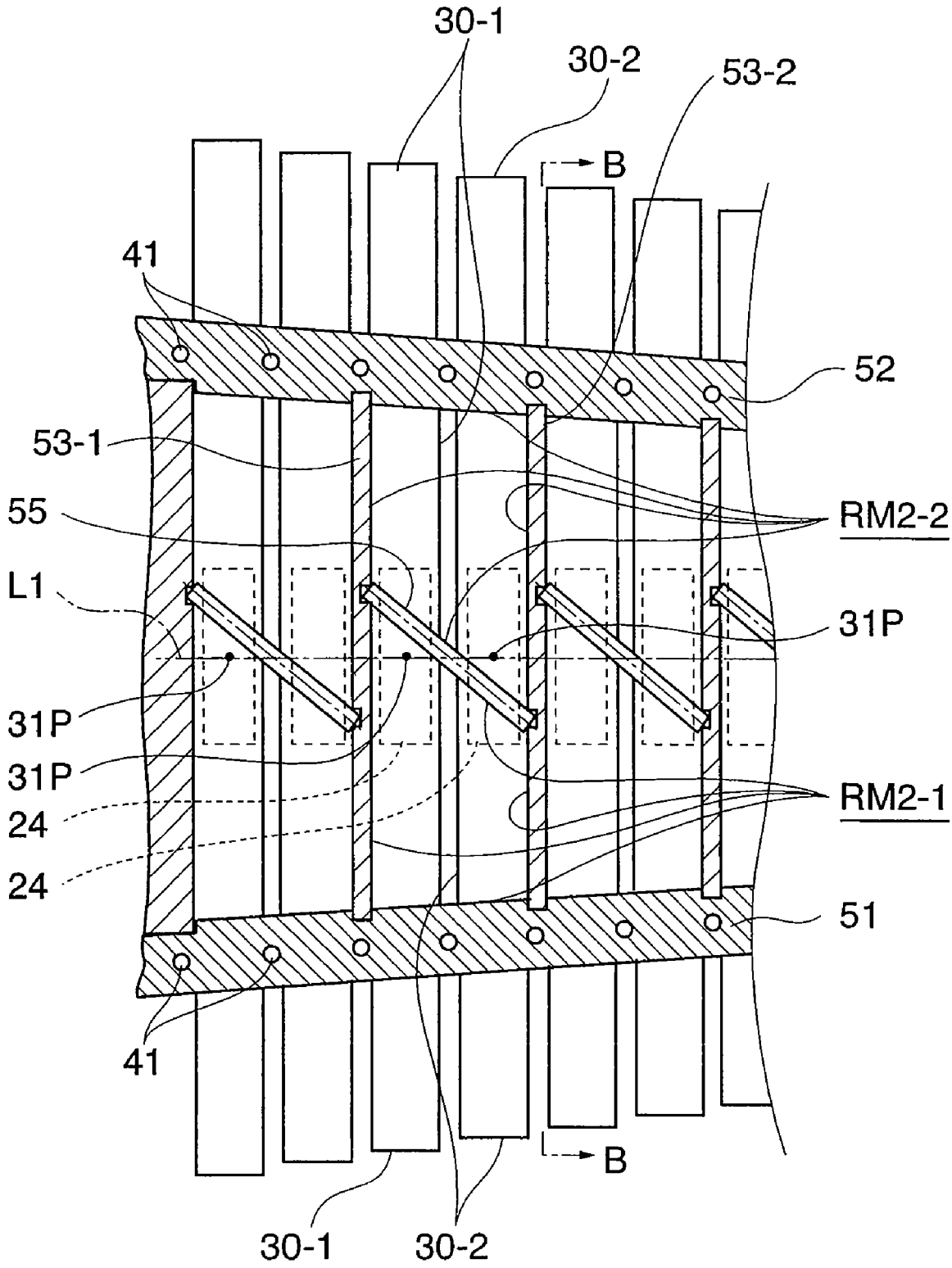
FIG. 10 is a fragmentary enlarged view of the mid-pitch portion shown in FIG. 6.

FIG. 10 shows in fragmentary enlarged view the mid-pitch range portion 50B of the resonance box 50 shown in FIG. 6. For discrimination, in FIG. 10, suffix numeral 1 is attached to one of two resonance chambers RM2 defined between each adjacent two of the partition plates 53, and suffix numeral 2 is attached to another of them. The resonance chamber RM2-1 is disposed on the front side of the resonance box 50, and the resonance chamber RM2-2 is disposed on the rear side thereof. To discriminate each adjacent two sounding members 30 disposed below the resonance chambers RM2-1, RM2-2 which are four in total, suffix numeral 1 is attached to one of the sounding members 30 and suffix numeral 2 is attached to the other thereof. To discriminate each adjacent two partition plates 53 defining the four resonance chambers RM2-1, RM2-2, suffix numeral 1 is attached to one of the partition plates 53 and suffix numeral 2 is attached to the other thereof.

In FIG. 10, positions of hammer felts 24 that strike sounding members 30 are shown by dotted lines. When any of the hammer felts 24 strikes the corresponding sounding member 30, the center position of a contact surface of the hammer felt 24 coincides with the position of the antinode center 31P of the sounding member 30 concerned. The antinode centers 31P of all the sounding members 30 are positioned on an imaginary straight line L1 passing through regions of all the resonance chambers RM1 to RM3. The antinode centers 31P of all the sounding members 30 are the same in position as viewed in the forward-to-backward direction. The antinode center 31P of each sounding member 30-1 is located below the resonance chamber RM2-1, and the antinode center 31P of each sounding member 30-2 is located below the resonance chamber RM2-2. In this way, the antinode center 31P of each sounding member 30 is located below the opening portion of the corresponding resonance chamber. Therefore, a musical tone generated when any of the sounding members 30-1 is struck by the corresponding hammer felt 24 resonates in the corresponding resonance chamber RM2-1, whereas a musical tone generated when any of the sounding members 30-2 is struck resonates in the corresponding resonance chamber RM2-2.

In this embodiment, each of the resonance chambers corresponding to respective ones of the sounding members 30 has its width nearly two times the width of the corresponding sounding member 30. Thus, it is ensured that a resonance chamber having a broad width is provided for each sounding member 30, making it possible to realize satisfactory resonance. In addition, only the width equal to the total width of two sounding members 30 is required for the provision of two resonance chambers, while ensuring that each of the resonance chambers for respective sounding members 30 can have a broad width. Thus, the entire width of the resonance box 50 in the left-to-right direction can be suppressed from increasing, making it possible to arrange the sounding members 30 in a one-stage structure.

Also in the low-pitch range portion 50A of the resonance box 50, a space defined between each adjacent two partition plates 53 is divided by an inclined plate 54, as in the case of the mid-pitch range portion 50B. The inclined plate 54, which is formed by a flat plate, extends obliquely relative to the partition plates 53 as seen from above, and is connected to central portions of these two partition plates 53, whereby two resonance chambers RM1 are defined in the space between each adjacent two partition plates 53. In the low-pitch range portion 50A in which the distance between each adjacent two partition plates 53 differs from that in the mid-pitch range portion 50B, an inclination angle of the inclined plate 54 relative to the two partition plates 53 differs from that of the inclined plate 55 relative to the partition plates 53. In the low-pitch range portion 50A of the resonance box 50, port-forming members 60 are provided on the front and rear common wall 51, 52 sides in a lower portion of each of resonance chambers RM1. Each port-forming member 60 is formed by a flat plate. Each of the port-forming members 60 on the front side is horizontally connected to the front common wall 51 and each adjacent two partition plates 53 disposed on the both sides of the resonance chamber RM1 concerned. Each of the port-forming members 60 on the rear side is horizontally connected to the rear common wall 52 and two partition plates 53 disposed on the both sides of the resonance chamber RM1.

Each resonance chamber RM1 is provided at its opening portion with a port, which is formed by the two partition plates 53 disposed on the both sides of the resonance chamber RM1, the inclined plate 54, and the port-forming member 60. In a Helmholtz-type resonance box, a musical tone resonating therein has a tone pitch that is generally affected by the length and sectional area of the port as well as the volume of the resonance box. For example, the tone pitch at which a musical tone resonates in the resonance box decreases with the increase in port length and with the decrease in port sectional area even when the volume of the resonance box is kept unchanged. In this embodiment, the port-forming member 60 is formed into a shape that is appropriately determined to adjust the length and sectional area of the port of each resonance chamber RM1 so that a musical tone generated by the corresponding sounding member 30 can satisfactorily resonate in the resonance chamber RM1.

Figure 11:
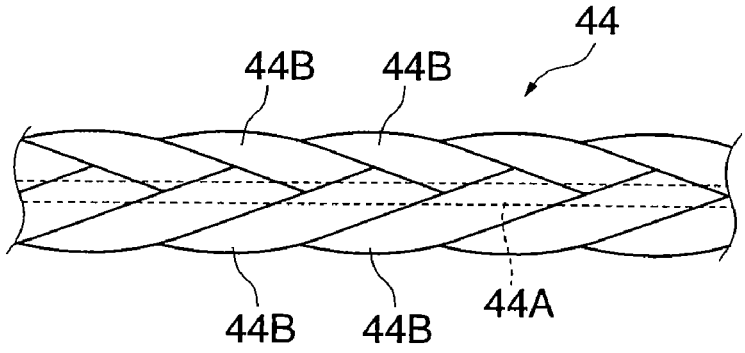
FIG. 11 is an external view of a supporting cord used for mounting the sounding members to the resonance box.

Next, an explanation will be given of the construction in which the sounding members 30 are arranged in a lower part of the resonance box 50. FIG. 11 shows an external appearance of a supporting cord 44, which is used for supporting the sounding members 30 below the resonance box 50. The supporting cord 44 is comprised of a core string 44A and a cord 44B wound around the core string 44A, and is formed into a circular shape in cross section. The core string 44A is made of nylon. The cord 44B is made of artificial leather having a suede-like surface. Specifically, the cord 44B is comprised of a string-shaped nonwoven fabric comprised of intertwined ultrafine fibers. The cord 44B is wound around the core string 44A with no space between turns of the cord to cover the core string 44A.

In mounting the sounding members 30 below the resonance box 50, the sounding members 30 are first brought together using the supporting cord 44. Specifically, the sounding members 30 are first arranged in the order of tone pitch in the left-to-right direction. The sounding member 30 for the lowest pitch tone is arranged on the leftmost side, whereas the sounding member 30 for the highest pitch tone is arranged on the rightmost side.

Next, the supporting cord 44 is inserted from left to right through the front supporting hole 36 of the leftmost sounding member 30. After inserted through the front supporting hole 36 of the leftmost sounding member 30, the cord 44 is inserted through the front supporting hole 36 of the right-hand neighbor of the leftmost sounding member 30. In this way, the supporting cord 44 is sequentially inserted through the front supporting holes 36 of all the sounding members 30 arranged in the order of tone pitch.

After inserted through the front supporting holes 36 of all the sounding members 30, the supporting cord 44 is inserted from right to left through the rear supporting hole 37 of the rightmost sounding member 30. After inserted through the rear supporting hole 37 of the rightmost sounding member 30, the cord 44 is inserted-through the rear supporting hole 37 of the left-hand neighbor of the rightmost sounding member 30. The supporting cord 44 is sequentially inserted through the rear supporting holes 37 of all the sounding members 30 arranged in the order of tone pitch.

After inserted through the front and rear supporting holes 36, 37 of all the sounding members 30, the both ends of the supporting cord 44 are tied together. By tying the both ends of the cord 44 together, all the sounding members 30 are brought together in the order of tone pitch.

Next, a plurality of fasteners 40 adapted to retain the supporting cord 44 below the resonance box 50 are mounted to the resonance box 50. FIG. 9A shows one of the fasteners 40 in side view and FIG. 9B shows the fastener 40 in fragmentary enlarged view. The fastener 40 is made of metal and includes a cord receiving portion 43 for retaining the supporting cord 44, a groove 42 through which the cord 44 passes through upon being inserted into the cord receiving portion 43, and a pin portion 41 adapted to be pressed into the resonance box 50. The cord receiving portion 43 is formed into a circular shape having an inner diameter thereof approximately equal to the diameter of the supporting cord 44. The groove 42 has its width slightly smaller than the diameter of the supporting cord 44. As a result, the supporting cord 44 inserted into the cord receiving portion 43 is not easily dismounted from the fastener 40.

The pin portion 41 of each fastener 40 is pressed into the front or rear common wall 51 or 52 of the resonance box 50. Each fastener 40 is pressed into the front common wall 51 with an opening portion of the groove 42 directed forward, or pressed into the rear common wall 52 with the opening portion of the groove 42 directed rearward. The distance between positions on the front or rear common wall in which pin portions 41 of each adjacent two fasteners 40 are pressed is larger than the width of the sounding member 30. As shown by way of example in FIG. 10, in the mid-pitch range portion 50B of the resonance box 50, the pin portion 41 of each fastener is pressed into the front or rear common wall at a position located on an imaginary extension line of the longitudinal axis of the partition plate 53 or on an imaginary line passing through an intersection of the inclined plate 55 and the imaginary line L1 and extending perpendicular to the line L1. In the low-pitch range portion 50A of the resonance box 50, the pin portion 41 of each fastener 40 is pressed into the front or rear common wall at a position similar to that in the mid-pitch range portion 50B. In the high-pitch range portion 50C, the pin portions 41 of the fasteners are pressed into the common walls, with a distance slightly wider than the width of the sounding member 30.

After the fasteners 40 have been pressed into the resonance box 50, the box 50 is turned with its lower surface facing up, and the sounding members 30 tied together by the supporting cord 44 are placed on the opening portion of the resonance box 50. Then, each adjacent sounding members 30 are moved apart to provide a gap therebetween, and the supporting cord 44 visible from between the sounding members 30 is inserted into the groove 42 of each fastener 40 and hung on the cord receiving portion 43 thereof. At that time, the supporting cord 44 is hung on the cord receiving portions 43 of the fasteners 40 such that one sounding member 30 is located between each adjacent two of the fasteners 40. After the supporting cord 44 is hung on the fasteners 40, the resonance box 50 is turned with its opening portion facing down.

Figure 12:
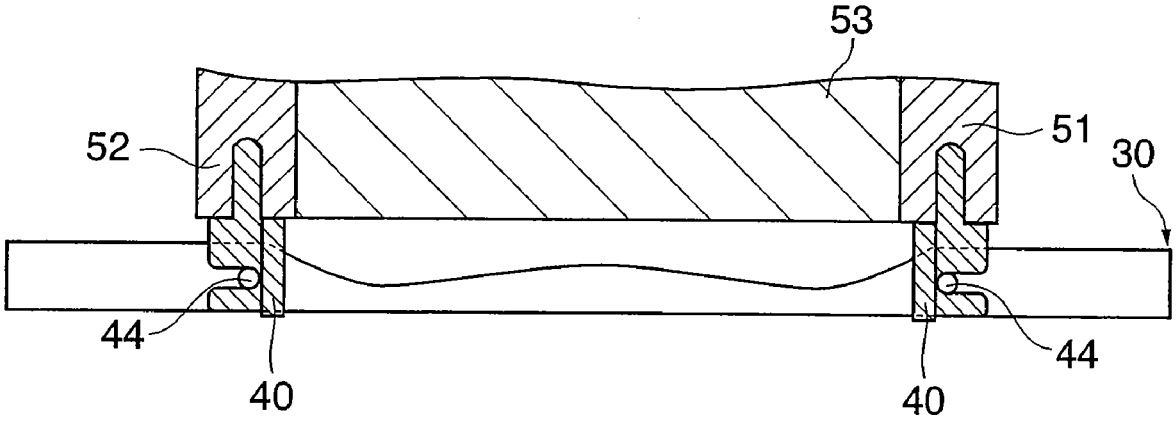
FIG. 12 is a fragmentary section view taken along line B-B in FIG. 10.

FIG. 12 is a section view taken along line B-B in FIG. 10. In a state where the opening portion of the resonance box 50 is directed downward, the supporting cord 44 is supported by the cord receiving portions 43 of the fasteners 40 at locations below the resonance box 50, as shown in FIG. 12. Since the supporting cord 44 is inserted through the supporting holes 36, 37 of the sounding members 30, these sounding members 30 are supported by the cord 44 so as to be suspended therefrom and capable of vibrating at locations below and in the vicinity of the opening portion of the resonance box 50.

Next, an explanation will be given of various parts of the percussion instrument 10 disposed below the tone generator unit UNT. As shown in FIGS. 2 to 4, between right and left side plates 18R, 18L forming opposite side surfaces of the percussion instrument 10, there is horizontally disposed a keybed 14 having three tone output ports 14*a* through which musical tones generated downward from the resonance box 50 pass. A key frame 15 is disposed on the keybed 14, a front rail 16 is disposed in front of the key frame 15, and a front portion of the front rail 16 is covered by a keyslip 17. On the key frame 15, balance rails 19 are disposed to correspond to respective ones of the white and black keys 27, 28 of the keyboard KB. The balance rails 19 are for supporting the white and black keys 27, 28 and provided with balance pins 62, 63. Each of the keys is supported by a corresponding balance rail 19 such that longitudinal end portions thereof are vertically pivotable around the balance pins 62, 63 as fulcrum.

On the key frame 15, action brackets 22 for supporting the action mechanisms 20 are disposed to correspond to respective ones of the keys. The action mechanisms 20 are the same in construction as those of a grand piano which strike strings provided therein. Each action mechanism 20 includes a hammer shank 23 adapted to be pivotable clockwise or counterclockwise around a fulcrum P1 in accordance with movement of a corresponding key of the keyboard KB, and a hammer felt 24 provided at a tip end of the hammer shank 23 for striking the corresponding sounding member 30.

Next, an explanation will be given of the construction on the rear side of the keyboard-type percussion instrument 10. On the rear side of the instrument 10, pivotal members 64 are disposed above the keybed 14 to correspond to respective ones of the keys of the keyboard KB. Damper wires 25 having damper felts 26 are attached to the pivotal members 64 to be pivotable clockwise or counterclockwise around fulcrums P2 shown in FIG. 2 in accordance with motions of the keys. Although not shown in FIG. 2, on the rear side of the percussion instrument 10, there is provided a mechanism for vertically moving all the pivotal members 64 provided to correspond to respective ones of the keys in accordance with a vertical motion of the pedal coupling rod 13A. When the damper pedal 12A is stepped on by the player, the pedal coupling rod 13A is moved upward, and all the pivotal members 64 are pivoted.

Figure 13:
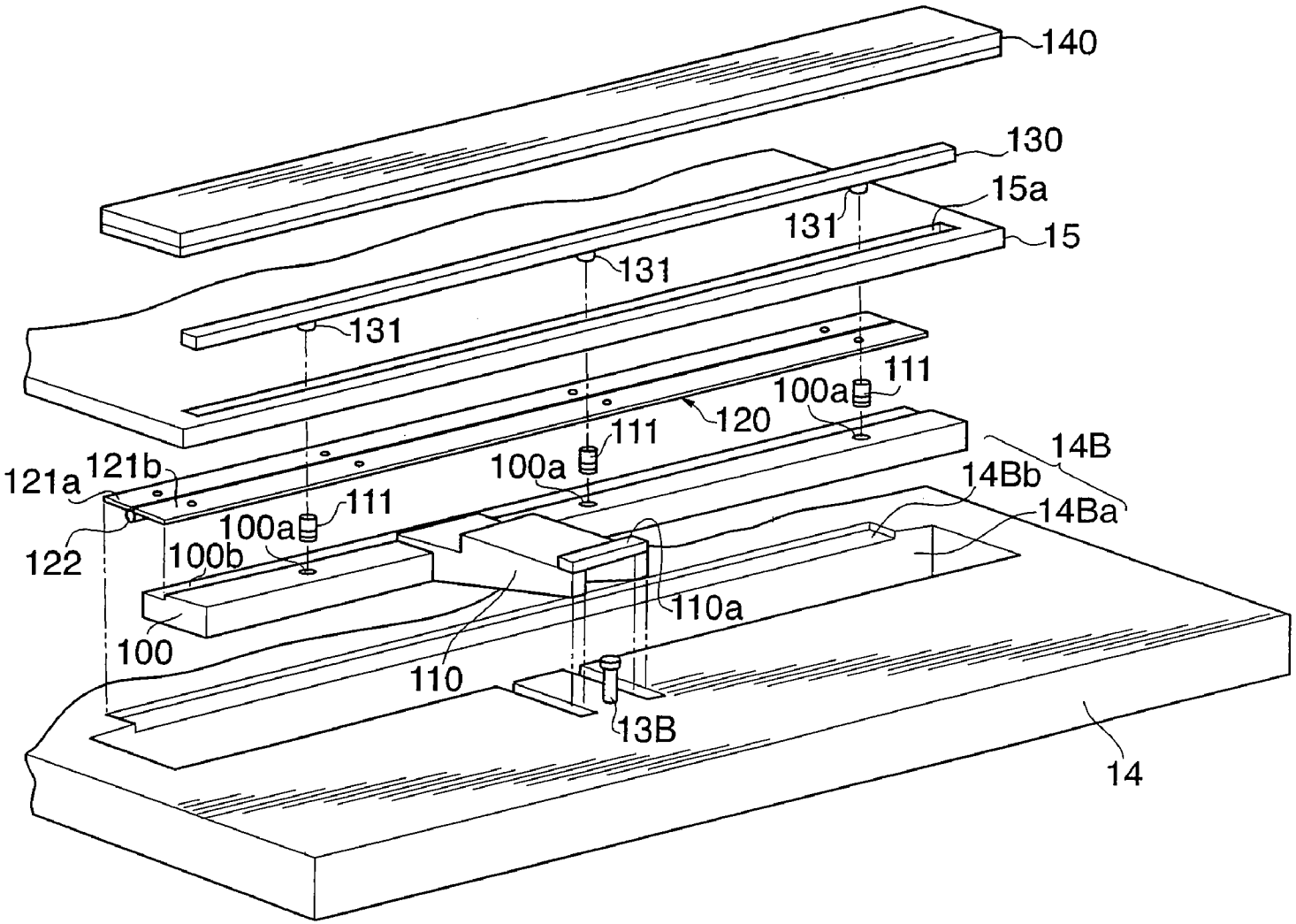
FIG. 13 is a fragmentary perspective view showing rear-side parts of a keybed and a key frame of the percussion instrument, together with a mechanism for vertically moving rear end portions of all the keys.

On the rear side of the keybed 14, there is disposed the mechanism for causing the rear end portions of all the keys to vertically move in accordance with a motion of the pedal connecting rod 13A. FIG. 13 shows in fragmentary view rear side parts of the keybed 14 and the key frame 15 together with the mechanism for causing the rear end portions of all the keys to move in the vertical direction.

As shown in FIG. 13, on the rear side of the keybed 14, there is provided a recessed portion 14B comprised of a rear-side recessed portion 14Ba and a front-side recessed portion 14Bb, which is deeper in depth than the rear-side recessed portion 14Ba.

At a further rear side of the recessed portion 14B, the keybed 14 is formed with a through hole (not shown) extending therethrough from its upper surface to its lower surface. The pedal connecting rod 13B is inserted through the through hole, as shown in FIG. 13. The depth of the recessed portion 14Ba (the distance between an upper surface of the keybed 14 and a bottom surface of the recessed portion 14Ba) is made larger than the thickness of a lifting arm 100 (the distance between upper and lower surfaces thereof), described later.

The lifting arm 100 is comprised of a plate-shaped member made of wood and having a rectangular bottom surface. The lifting arm 100 has an upper side thereof formed with three threaded holes 100*a* and a stepped portion 110*b*. An arm member 110 is attached to a rear side of the lifting arm 100. The arm member 110 has an arm portion 110*a* thereof extending in the left-to-right direction and disposed in contact with the pedal connecting rod 13B.

There are provided capstan screws 111 each comprised of a cylindrical member having a lower part thereof formed with threads and adapted to be threadedly inserted into a corresponding one of the threaded holes 100*a*. When the capstan screws 111 are screwed into the threaded holes 100*a*, those parts of the capstan screws 111 which are not formed with threads project upward from the upper surface of the lifting arm 100.

A hinge 120 with which the lifting arm 100 is attached to the keybed 14 includes a rod 122 and plate-shaped blades 121*a*, 121*b*. The blade 121*a* is fixed to the recessed portion 14Bb of the keybed 14 using screw, not shown, and the blade 121*b* is fixed to the stepped portion 100*b* of the lifting arm 100 using screws, not shown. The blades 121*a*, 121*b* are adapted to be pivoted around the rod 122 in the direction circumferentially of the rod 122. In a state where the lifting arm 100 is attached to the keybed 14 through the hinge 20, the lifting arm 100 is pivotable relative to the keybed 14 around the rod 120*a*.

A lifting bar 130 is formed by a column-shaped member made of metal. The lifting bar 130 is formed at its lower surface with three cylindrical projecting portions 131, and is adapted to be inserted into a rectangular recessed portion 15*a* formed in a rear side of the key frame 15 in the left-to-right direction. The lifting bar 130 has its left-to-right length slightly longer than the distance between rear end portions of the leftmost and rightmost keys.

The recessed portion 15*a* of the key frame 15 has a bottom surface thereof formed with three through holes 15*b* that extend through the key frame 15 from a lower surface of the key frame to the recessed portion 15*a*. The distance between adjacent through holes 15*b* is the same as the distance between adjacent projecting portions 131 of the lifting bar 130. When the lifting bar 130 is inserted into the recessed portion 15*a*, the projecting portions 131 are fitted into the through holes 15*b* such that an upper surface of the key frame 15 is made to be flush with an upper surface of the lifting bar 130 and a lower surface of the key frame 15 is made to be flush with a lower surface of the projecting portion 131.

Further, there is provided a belt-shaped back felt 140 whose left-to-right length is nearly equal to that of the lifting bar 130. The back felt 140 is mounted on the lifting bar 130 inserted into the recessed portion 15*a* of the key frame 15. Although not shown in FIG. 13, the rear end portions of all the keys are placed on the back felt 140.

Figure 14:
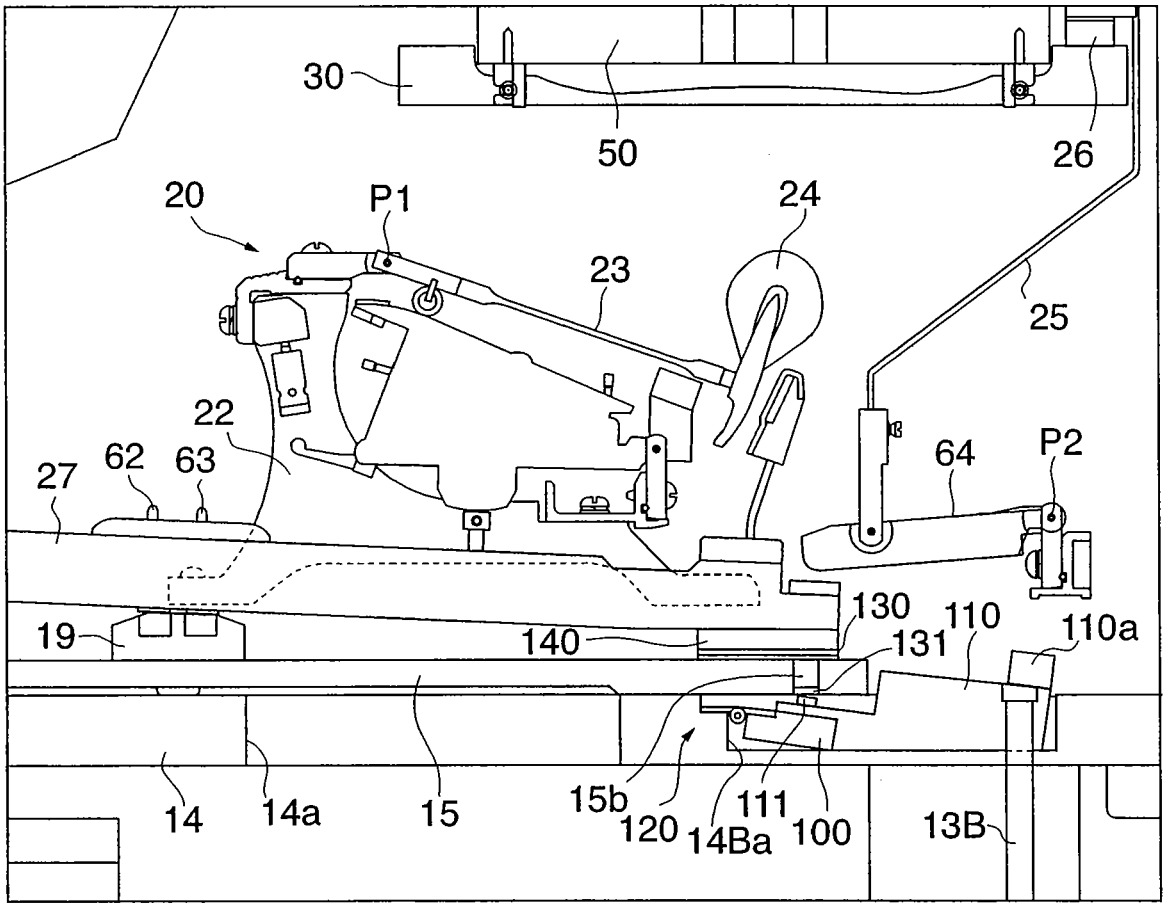
FIG. 14 is an enlarged view showing a rear end portion of the key shown in FIG. 2 and its vicinity.

FIG. 14 is an enlarged view showing the rear end portion of the key shown in FIG. 2 and the vicinity thereof. In a state where various parts shown in FIG. 13 have been assembled together, when the soft pedal 12B is not stepped on, the pedal connecting rod 13B is at its down position, and hence the lifting arm 100 is at a down position thereof and is in contact with a bottom surface of the recessed portion 14Ba. When the lifting arm 100 is at its down position, the capstan screws 111 are not inserted into the through holes 15*b* and in contact with the projecting portions 131, and the upper surface of the lifting bar 130 does not project from but is in flush with the upper surface of the key frame 15.

Figure 16:
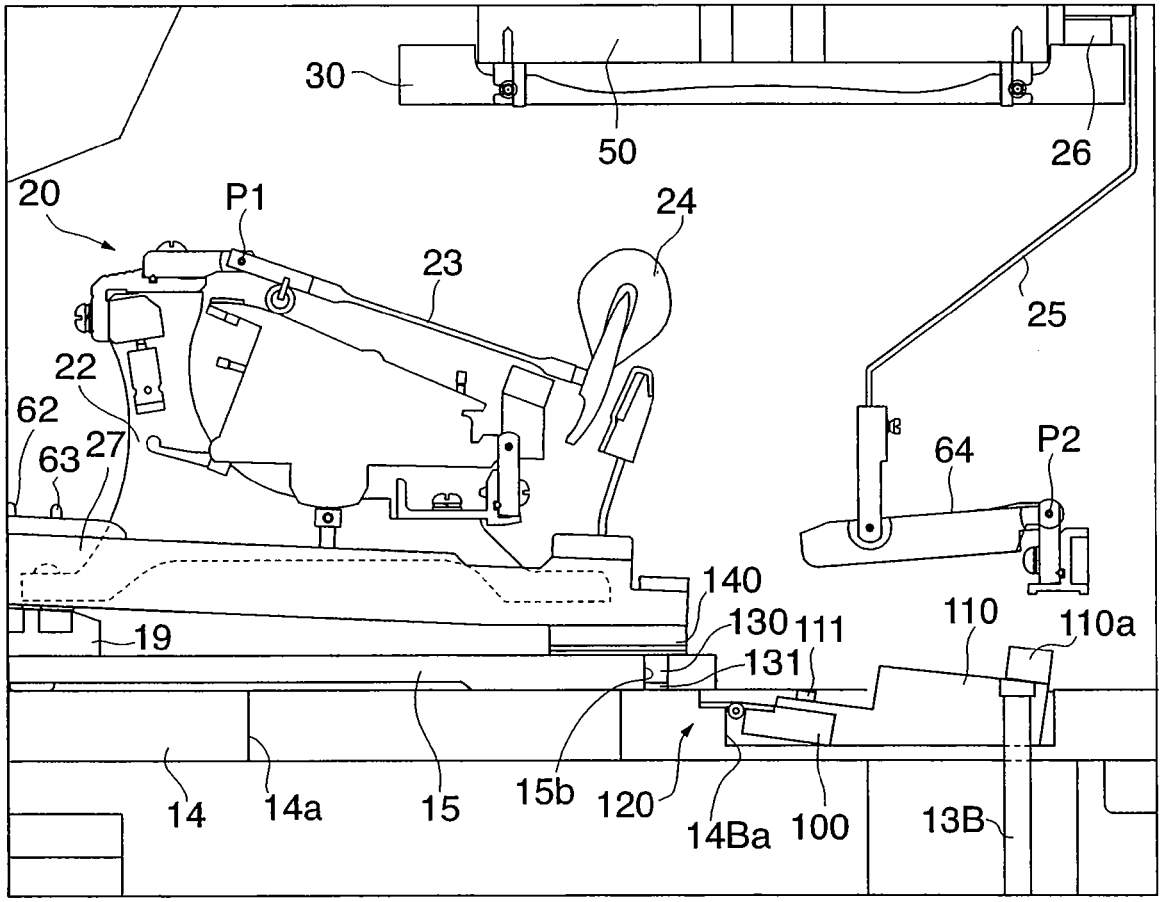
FIG. 16 is an enlarged view showing the rear end portion of the key in a state where the key frame is pulled out forward.

In that state, the upper surface of the key frame 15 is at the same height as the upper surface of the lifting bar 130, and the lower surface of the key frame 15 is at the same height as the lower surface of the projecting portion 131. Thus, the key frame 15 can easily be pulled out forward as shown in FIG. 16, without being stuck. The key frame 15 is unitized with the keyboard KB and the action mechanisms 20 such that the key frame 15, the keyboard KB, and the action mechanisms 20 can be handled as one unit, making it easy to perform maintenance.

According to the above described construction, when any of the keys of the keyboard KB is depressed by the player, the rear end portion of the depressed key is moved upward and the pivotal member 64 corresponding thereto is pivoted clockwise in FIG. 2. On the other hand, when the damper pedal 12 is not stepped on and none of the keys is depressed, the damper felts 26 are in contact with the sounding members 30, as shown in FIG. 2. When one of the pivotal members 64 is pivoted clockwise as mentioned above, the corresponding damper wire 25 is moved upward and the damper felt 26 is made out of contact with the sounding member 30. When any of the keys is depressed downward, the corresponding action mechanism 20 causes the hammer shank 23 to be pivoted counterclockwise and the hammer felt 24 strikes the sounding member 30. When struck by the hammer felt 24, the sounding member 30 vibrates since the damper felt 26 is kept apart from the sounding member 30 at that time.

A musical tone generated by a struck and vibrating sounding members 30 is caused to resonate in the resonance box 50 and then output downward from the resonance box 50. The musical tone output from the resonance box 50 passes through the tone output ports 14*a* located below the action mechanisms and is directed downward of the keybed 14.

Subsequently, when the player's finger is taken off the depressed key, the rear end portion of the key is moved downward, and the action mechanism 20 causes the hammer shank 23 to be pivoted clockwise, so that the hammer felt 24 is moved away from the sounding member 30. In accordance with the motion of the rear end portion of the key, the pivotal member 64 is pivoted counterclockwise. As a result, the damper wire 25 is moved downward and the damper felt 26 is made in contact with the sounding member 30, whereby the sounding member 30 is suppressed from vibrating.

When the damper pedal 12A is stepped on, the pedal coupling rod 13A is moved upward, and all the pivotal members 64 are pivoted clockwise around the fulcrums P2. Thus, all the damper felts 26 corresponding to respective ones of the keys are moved apart from the sounding members 30. When the damper pedal 12A is stepped on to cause the pivotal members 64 to be pivoted clockwise, the rear end portions of the keys are made out of contact with the pivotal members 64 and a sounding member 30 corresponding to a depressed key is not suppressed from vibrating by the damper felt 26, even if the player's finger is taken off the depressed key.

Figure 15:
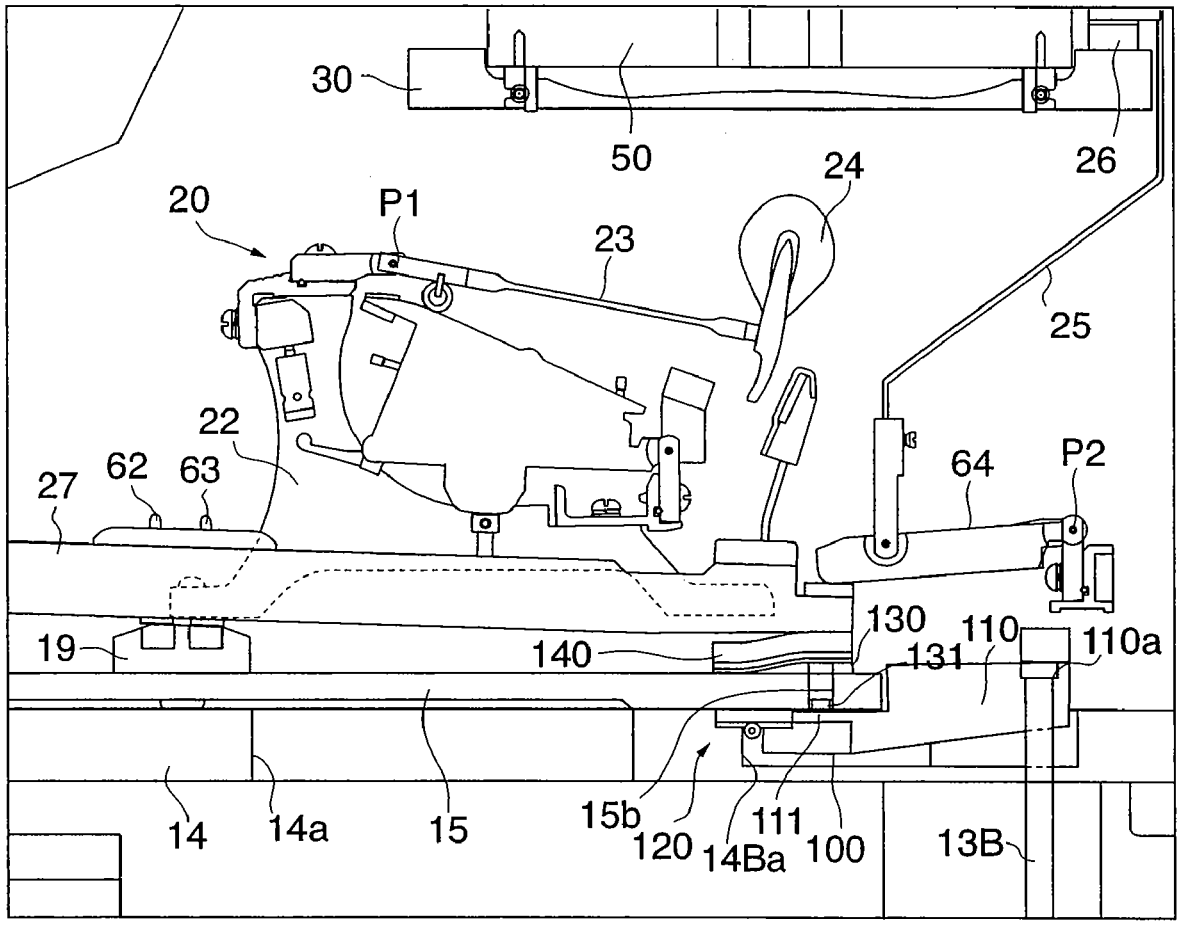

When the soft pedal 12B is stepped on by the player, the pedal connecting rod 13B is moved upward as shown in FIG. 15, and the arm portion 110*a* of the lifting arm 100 in contact with the pedal connecting rod 13B is moved upward by the rod 13B. As a result, the lifting arm 100 is pivoted counterclockwise around the rod of the hinge 120 from a state shown in FIG. 14, and the capstan screws 111 are inserted into the through holes 15*b*. The projecting portions 131 of the lifting bar 130 are moved upward by the capstan screws 111 inserted into the through holes 15*b*, and the upper surface of the lifting bar 130 projects from the upper surface of the key frame 15. The lifting bar 130 projecting from the upper surface of the key frame 15 pushes the rear end portions of all the keys upward together with the back felt 140.

When the rear end portions of the keys are pushed upward, the hammer shanks 23 are pivoted counterclockwise by the action mechanisms 20. As a result, the standby positions of the hammer felts 24 are moved toward the sounding members 30 as compared to a case where the soft pedal 12B is not stepped on, and hence the distance between the hammer felts 24 and the sounding members becomes smaller. As a consequence, the acceleration of each hammer felt 24 upon a key depression force being applied is reduced, and therefore, the volume of a tone produced when any of the sounding members is struck is decreased, as compared to a case where the soft pedal 12B is not stepped on.

Figure 17A:
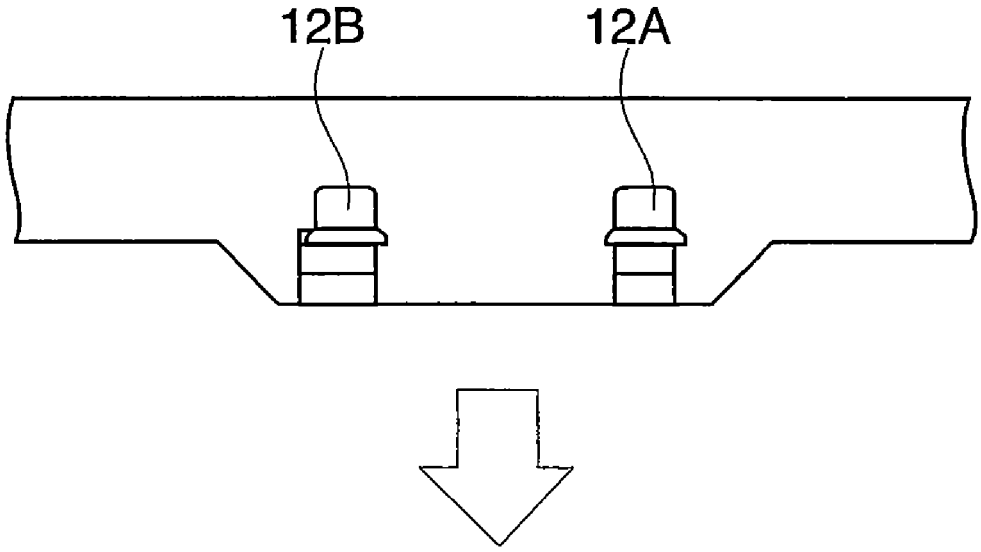
Figure 17B:
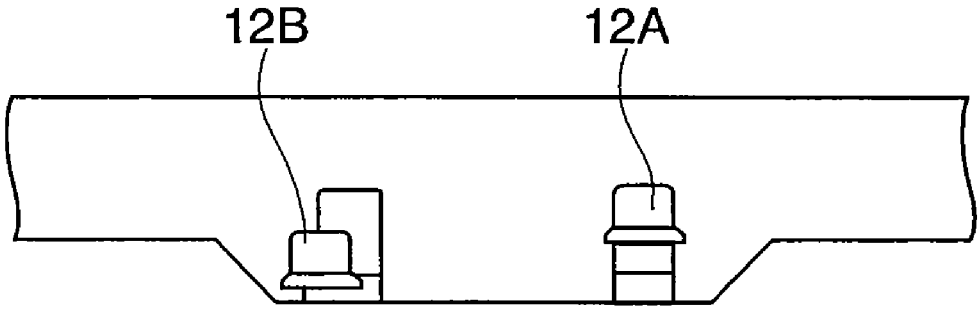
FIG. 17B is an enlarged view showing the soft pedal and its vicinity in a state where the soft pedal is maintained in its stepped-on state.

The soft pedal 12B is adapted to be retained in the stepped-on state when moved to the left after being stepped on. FIGS. 17A and 17B show in enlarged view the pedal part shown in FIG. 1C. When the soft pedal 12B is stepped on and then moved leftward as shown in FIG. 17B, from a state shown in FIG. 17A where the soft pedal 12B is not stepped on, the soft pedal 12B is kept in its stepped-on state. In that case, even if the foot of the player is removed from the soft pedal 12B, the rear end portions of the keys are kept pushed upward, so that the volume of tones generated from sounding members 30 remain small as compared to a case where the soft pedal 12B is not stepped on.

In the above, one embodiment of this invention has been described. This invention is not limitative to the above described embodiment and can be embodied in other forms. For example, this invention can be embodied according to a modification of the embodiment, briefly described below.

The above described construction for moving the rear end portions of keys upward can be provided in a keyboard-type glockenspiel or other musical instrument.

What is claimed is:

1. A keyboard-type percussion instrument comprising:

a plurality of keys;

sounding members arranged to correspond to respective ones of said keys and each adapted to generate, when struck, a musical tone of a tone pitch proper to the sounding member;

action mechanisms arranged to correspond to respective ones of said keys and each having a hammer adapted to strike a corresponding one of said sounding members in accordance with a motion of a corresponding one of said keys;

a pedal; and a standby position adjusting unit adapted to change positions of said hammers observed when said plurality of keys are in a standby state in accordance with a motion of said pedal.

2. The keyboard-type percussion instrument according to claim 1, wherein said plurality of keys are each supported by a fulcrum for pivotal motion around the fulcrum;

each of said hammers is adapted to strike a corresponding one of said sounding members with a pivotal motion of a corresponding one of said keys; and said standby position adjusting unit is adapted to move the positions of said hammers observed when said plurality of keys are in the standby state in accordance with a motion of said pedal.

3. The keyboard-type percussion instrument according to claim 1, wherein the positions of said hammers observed when said plurality of keys are in the standby state and having been changed in accordance with a motion of said pedal are fixed by said pedal being operated in a predetermined direction.

4. The keyboard-type percussion instrument according to claim 1, wherein said plurality of keys and said action mechanisms arranged to correspond to respective ones of said keys are unitized by being supported by a key frame.

* * * * *